US006665409B1

(12) United States Patent
Rao

(10) Patent No.: US 6,665,409 B1
(45) Date of Patent: Dec. 16, 2003

(54) METHODS FOR SURROUND SOUND SIMULATION AND CIRCUITS AND SYSTEMS USING THE SAME

(75) Inventor: Raghunath K. Rao, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 09/287,713

(22) Filed: Apr. 7, 1999

(51) Int. Cl.[7] ..... H04R 25/00

(52) U.S. Cl. ..... 381/63; 381/61; 381/307; 84/630

(58) Field of Search ..... 351/61, 63, 15, 351/307; 84/630; 711/123, 125, 126

(56) References Cited

U.S. PATENT DOCUMENTS

| | | | | |
|---|---|---|---|---|
| 4,063,034 A | * | 12/1977 | Peters | 381/17 |
| 4,219,880 A | | 8/1980 | Nichols | |
| 4,802,119 A | | 1/1989 | Heene et al. | |
| 4,991,217 A | | 2/1991 | Garrett et al. | |
| 5,193,204 A | | 3/1993 | Qureshi et al. | |
| 5,206,884 A | | 4/1993 | Bhaskar | |
| 5,235,671 A | | 8/1993 | Mazor | |
| 5,251,260 A | * | 10/1993 | Gates | 381/18 |
| 5,436,900 A | | 7/1995 | Hammar et al. | |
| 5,491,754 A | * | 2/1996 | Jot et al. | 381/63 |
| 5,491,771 A | | 2/1996 | Gupta et al. | |
| 5,497,373 A | | 3/1996 | Hulen et al. | |
| 5,530,762 A | * | 6/1996 | Jones et al. | 381/63 |
| 5,553,063 A | | 9/1996 | Dickson | |
| 5,652,903 A | | 7/1997 | Weng et al. | |
| 5,689,571 A | * | 11/1997 | Kitamura | 381/63 |
| 5,761,516 A | | 6/1998 | Rostoker et al. | |
| 5,768,613 A | | 6/1998 | As ghar | |
| 5,835,375 A | | 11/1998 | Kitamura | |

FOREIGN PATENT DOCUMENTS

| | | |
|---|---|---|
| EP | 0 514 949 A2 | 11/1992 |
| EP | 0 682 337 A1 | 11/1995 |
| EP | 0 734 021 A2 | 9/1996 |

OTHER PUBLICATIONS

"About this Reverberaton Business" James A. Moorer, IRCAM p. 13–27.

"ColorlessÄrtifical Reverberation " by M.R. Schroeder & B.F. Logan, Journal of the Audio ENgineering Society,Jul. 1969, vol. 9, No. 3 pgx. 192–197.

"Natural SOunding Artificial Reverberation" by M.R. Schroeder Journal of The Audio Engineering Societ, Jul. 1962, vol. 10, No. 3 pp. 219–223.

"25 Years of Digital Synthesizer Architecture" By Kahrs, et al. 103rd Convention of Audio Engineering Society Pre-Prints 1997, Sep. 26–29, M 7 4595.

* cited by examiner

*Primary Examiner*—Curtis Kuntz
*Assistant Examiner*—Tuân Duć Nguyên
(74) *Attorney, Agent, or Firm*—James J. Murphy; Winstead Sechrest & Minick

(57) ABSTRACT

A method of producing reverberation effects is disclosed. A filter is implemented for modeling early acoustic reflections in response to an input signal using a first processor, the filter includes a delay buffer of a selected length and having a selected number of taps for tapping samples of corresponding amounts of delay and a summer for summing the tapped samples to generate a filter output signal. A reverberator is implemented for modeling late acoustic reflections using a second processor, the reverberator receiving the filter output and generating a plurality of output signals.

21 Claims, 8 Drawing Sheets

FIG. 5
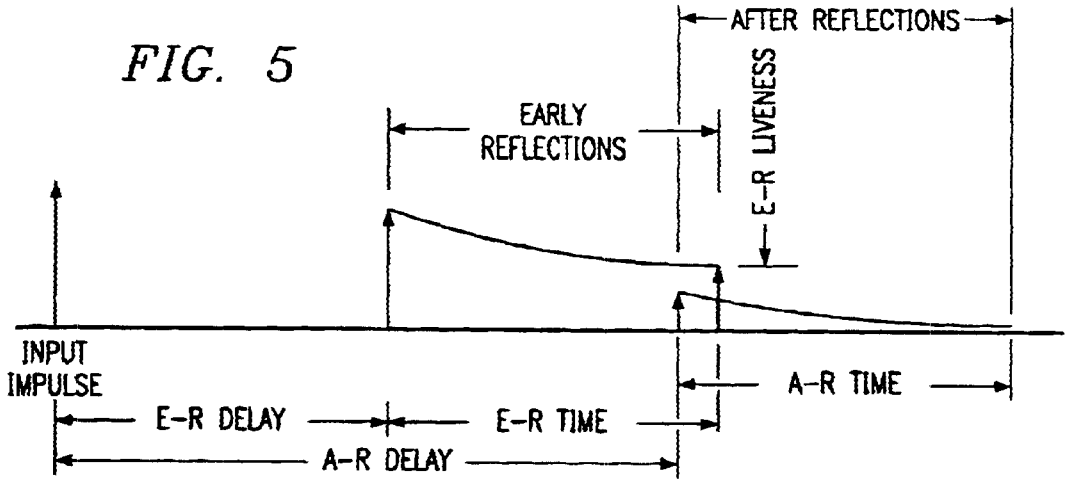
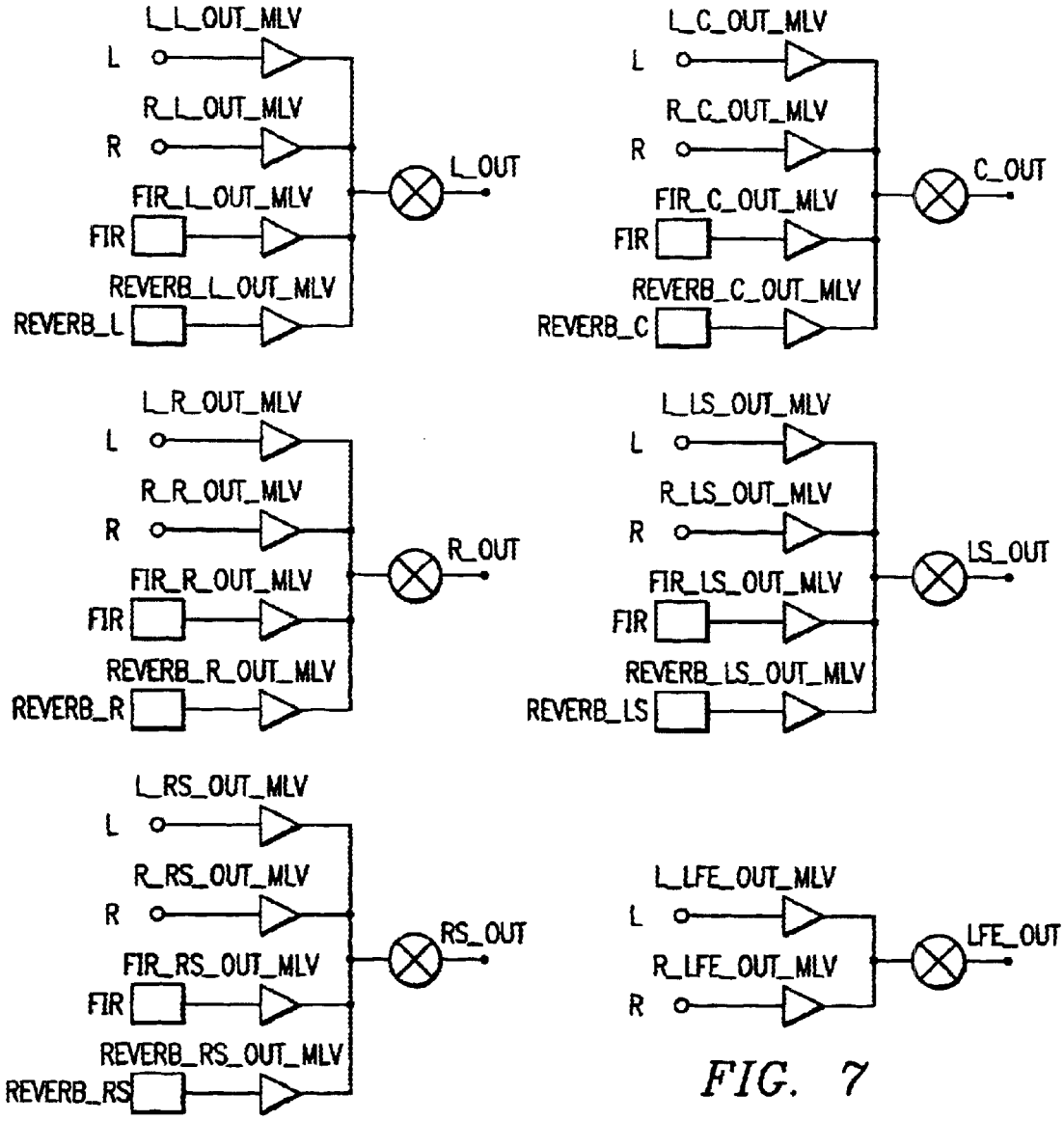
FIG. 7

METHODS FOR SURROUND SOUND SIMULATION AND CIRCUITS AND SYSTEMS USING THE SAME

CROSS-REFERENCE TO RELATED APPLICATION

The following co-assigned application contains related information and is hereby incorporated by reference: Ser. No. 08/970,979, entitled "DIGITAL AUDIO DECODING CIRCUITRY, METHODS AND SYSTEMS", filed Nov. 14, 1997.

BACKGROUND OF THE INVENTION

1. Field of the Invention

The present invention relates in general to audio data processing and in particular, methods for surround sound simulation and circuits and systems using the same.

2. Description of the Related Art

The ability to process audio information has become increasingly important in the personal computer (PC) environment. Among other things, audio is important in many multimedia applications, such as gaming and telecommunications. Audio functionality is therefore typically available on most conventional PCs, either in the form of an add-on audio board or as a standard feature provided on the motherboard itself. In fact, PC users increasingly expect not only audio functionality but high quality sound capability. Additionally, digital audio plays a significant role outside the traditional PC realm, such as in compact disk players, VCRs and televisions. As the audio technology progresses, digital applications are increasingly sophisticated as improvements in sound quality and sound effects are sought.

One of the key components in many digital audio information processing systems is the decoder. Generally, the decoder receives data in a compressed form and converts that data into a decompressed digital form. The decompressed digital data is then passed on for further processing, such as filtering, expansion or mixing, conversion into analog form, and eventually conversion into audible tones. In other words the decoder must provide the proper hardware and software interfaces to communicate with the possible compressed (and decompressed) data sources, as well as the destination digital and/or audio devices. In addition, the decoder must have the proper interfaces required for overall control and debugging by a host microprocessor or microcontroller. Since, there are a number of different audio compression/decompression formats and interface definitions, such as Dolby AC-3 and S/PDIF (Sony/Phillips Digital Interface), a state of the art digital audio decoder should at least be capable of supporting multiple compression/decompression formats.

Another feature often demanded by the customer is the ability of an audio system to perform effects processing. For example, surround sound and reverberation processing are often important to the user since they allow recorded music to be replayed in a simulated concert hall environment. It would be a significant advantage if such effects processing capability could also be supported by the audio decoder chip.

SUMMARY OF THE INVENTION

A method of producing reverberation effects is disclosed. A filter is implemented for modeling early acoustic reflections in response to an input signal using a first processor, the filter including a delay buffer of a selected length and having a selected number of taps for tapping samples of corresponding amounts of delay and a summer for summing the tapped samples to generate a filter output signal. A reverberator is implemented for modeling late acoustic reflections using a second processor, the reverberator receiving the filter output and generating a plurality of output signals.

The principles of the present invention allow for the efficient support of audio effects processing in a multiprocessor environment. Among other things, the principles allow for surround sound and reverberation effects processing on a single chip audio decoder.

BRIEF DESCRIPTION OF THE DRAWINGS

For a more complete understanding of the present invention, and the advantages thereof, reference is now made to the following descriptions taken in conjunction with the accompanying drawings, in which:

FIG. 5 is a diagram illustrating the response to a test impulse signal;

FIG. 7 is a diagram illustrating the output channel mixer;

DESCRIPTION OF THE PREFERRED EMBODIMENTS

The principles of the present invention and their advantages are best understood by referring to the illustrated embodiment depicted in FIGS. 1–9 of the drawings, in which like numbers designate like parts.

Figure 1A:
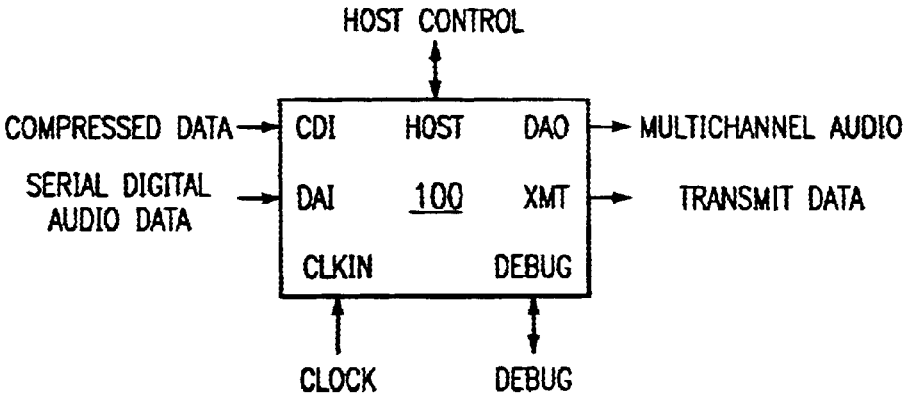
FIG. 1A is a diagram of a multichannel audio decoder embodying the principles of the present invention.

FIG. 1A is a general overview of an audio information decoder 100 embodying the principles of the present invention. Decoder 100 is operable to receive data in any one of a number of formats, including compressed data in conforming to the AC-3 digital audio compression standard, (as defined by the United States Advanced Television System Committee) through a compressed data input port CDI. An independent digital audio data (DAI) port provides for the input of PCM, S/PDIF, or non-compressed digital audio data.

A digital audio output (DAO) port provides for the output of multiple-channel decompressed digital audio data. Independently, decoder 100 can transmit data in the S/PDIF (Sony-Phillips Digital Interface) format through a transmit port XMT.

Decoder 100 operates under the control of a host microprocessor through a host port HOST and supports debugging by an external debugging system through the debug port DEBUG. The CLK port supports the input of a master clock for generation of the timing signals within decoder 100.

While decoder 100 can be used to decompress other types of compressed digital data, it is particularly advantageous to use decoder 100 for decompression of AC-3 bits streams. For a more complete description of AC-3 compression, reference is now made to the Digital Audio Compression Standard (AC-3) available form the Advanced Television Systems Committee, herein incorporated by reference.

Figure 1B:
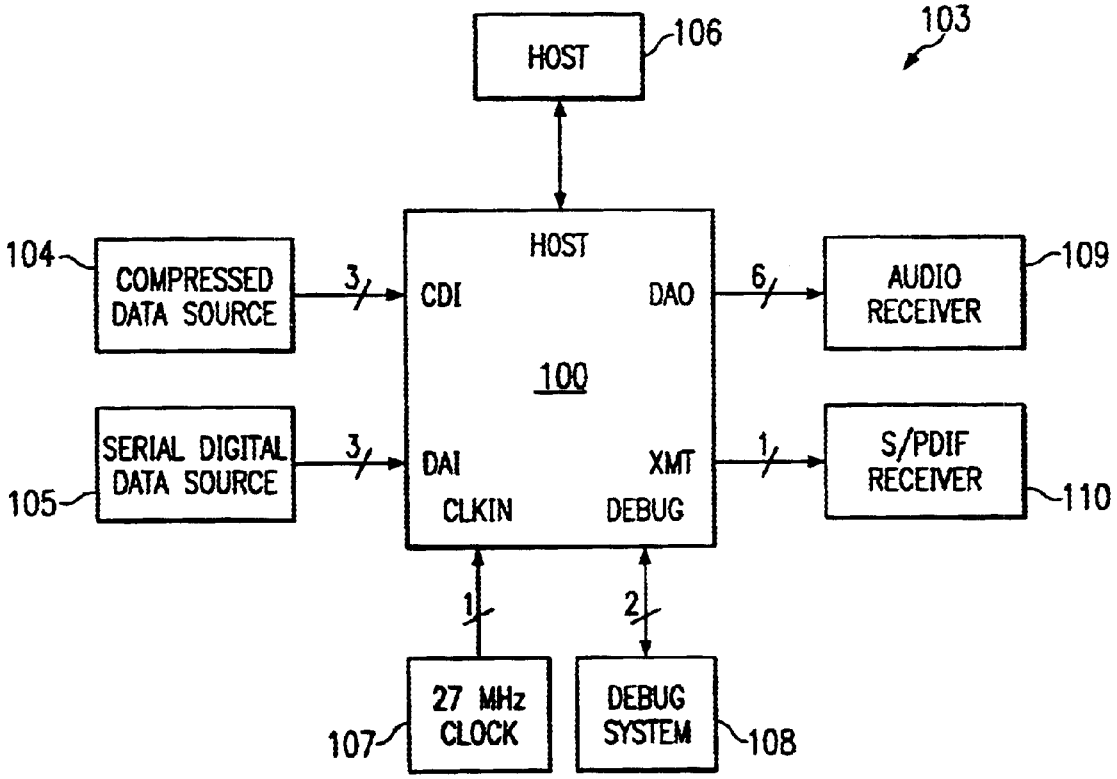
FIG. 1B is a diagram showing the decoder of FIG. 1 in an exemplary system context.

FIG. 1B shows decoder 100 embodied in a representative system 103. Decoder 100 as shown includes three compressed data input (CDI) pins for receiving compressed data from a compressed audio data source 104 and an additional three digital audio input (DAI) pins for receiving serial digital audio data from a digital audio source 105. Examples of compressed serial digital audio source 105, and in particular of AC-3 compressed digital sources, are digital video discs and laser disc players.

Host port (HOST) allows coupling to a host processor 106, which is generally a microcontroller or microprocessor that maintains control over the audio system 103. For instance, in one embodiment, host processor 106 is the microprocessor in a personal computer (PC) and System 103 is a PC-based sound system. In another embodiment, host processor 106 is a microcontroller in an audio receiver or controller unit and system 103 is a non-PC-based entertainment system such as conventional home entertainment systems produced by Sony, Pioneer, and others. A master clock, shown here, is generated externally by clock source 107. The debug port (DEBUG) consists of two lines for connection with an external debugger, which is typically a PC-based device.

Decoder 100 has six output lines for outputting multichannel audio digital data (DAO) to digital audio receiver 109 in any one of a number of formats including 3-lines out, 2/2/2, 4/2/0, 4/0/2 and 6/0/0. A transmit port (XMT) allows for the transmission of S/PDIF data to an S/PDIF receiver 110. These outputs may be coupled, for example, to digital to analog converters or codecs for transmission to analog receiver circuitry.

Figure 1C:
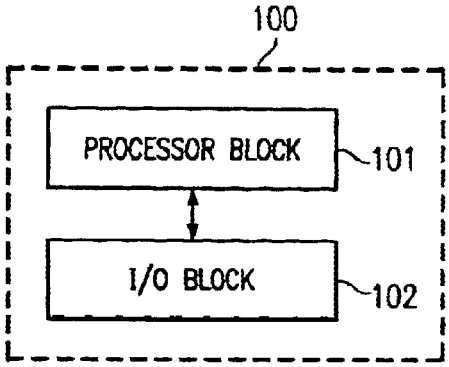
FIG. 1C is a diagram showing the partitioning of the decoder into a processor block and an input/output (I/O) block.

FIG. 1C is a high level functional block diagram of a multichannel audio decoder 100 embodying the principles of the present invention. Decoder 100 is divided into two major sections, a Processor Block 101 and the I/O Block 102. Processor Block 106 includes two digital signal processor (DSP) cores, DSP memory, and system reset control. I/O Block 102 includes interprocessor communication registers, peripheral I/O units with their necessary support logic, and interrupt controls. Blocks 101 and 102 communicate via interconnection with the I/O buses of the respective DSP cores. For instance, I/O Block 102 can generate interrupt requests and flag information for communication with Processor Block 101. All peripheral control and status registers are mapped to the DSP I/O buses for configuration by the DSPs.

Figure 2:
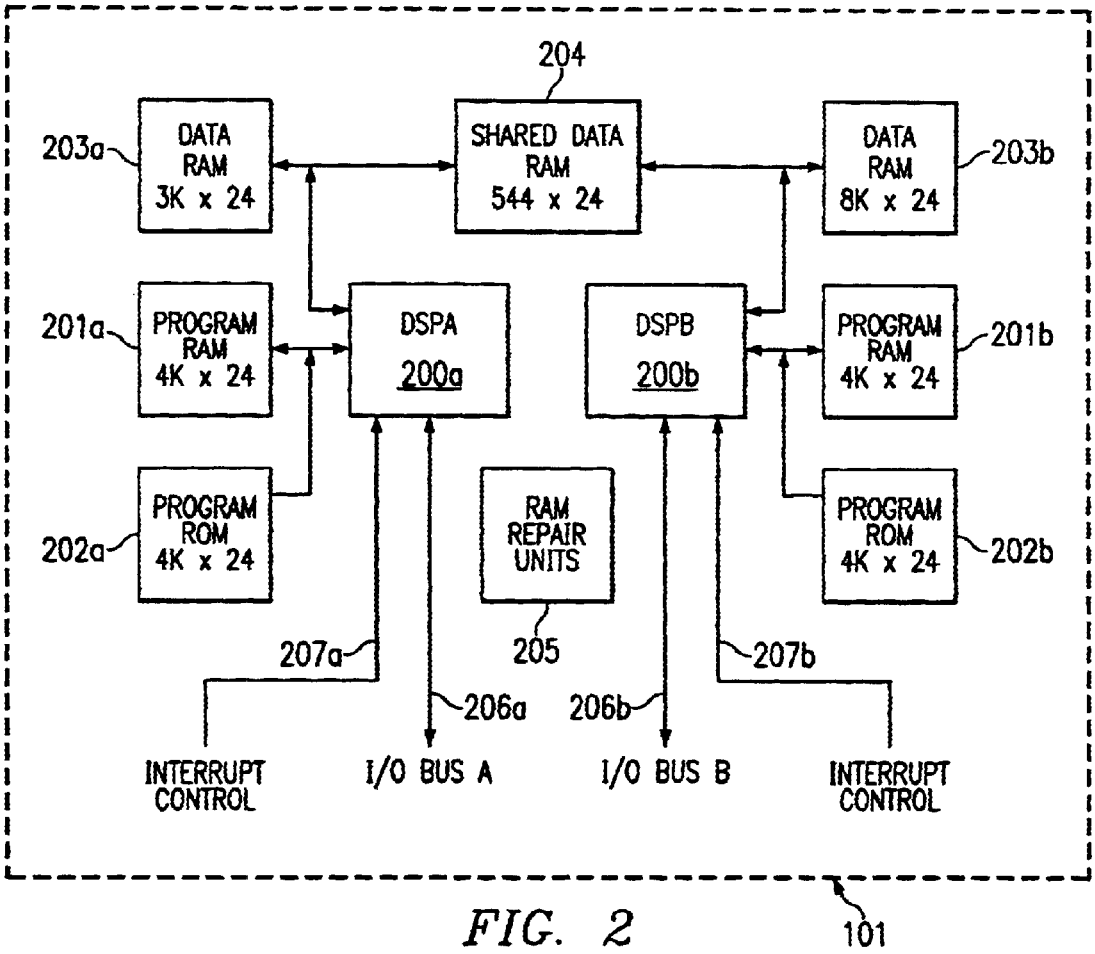
FIG. 2 is a diagram of the processor block of FIG. 1C.

FIG. 2 is a detailed functional block diagram of processor block 101. Processor block 101 includes two DSP cores 200*a* and 200*b*, labeled DSPA and DSPB respectively. Cores 200*a* and 200*b* operate in conjunction with respective dedicated program RAM 201*a* and 201*b*, program ROM 202*a* and 202*b*, and data RAM 203*a* and 203*b*. Shared data RAM 204, which the DSPs 200*a* and 200*b* can both access, provides for the exchange of data, such as PCM data and processing coefficients, between processors 200*a* and 200*b*. Processor block 101 also contains a RAM repair unit 205 that can repair a predetermined number of RAM locations within the on-chip RAM arrays to increase die yield.

DSP cores 200*a* and 200*b* respectively communicate with the peripherals through I/O Block 102 via their respective I/O buses 206*a*, 206*b*. The peripherals send interrupt and flag information back to the processor block via interrupt interfaces 207*a*, 207*b* .

Figure 3:
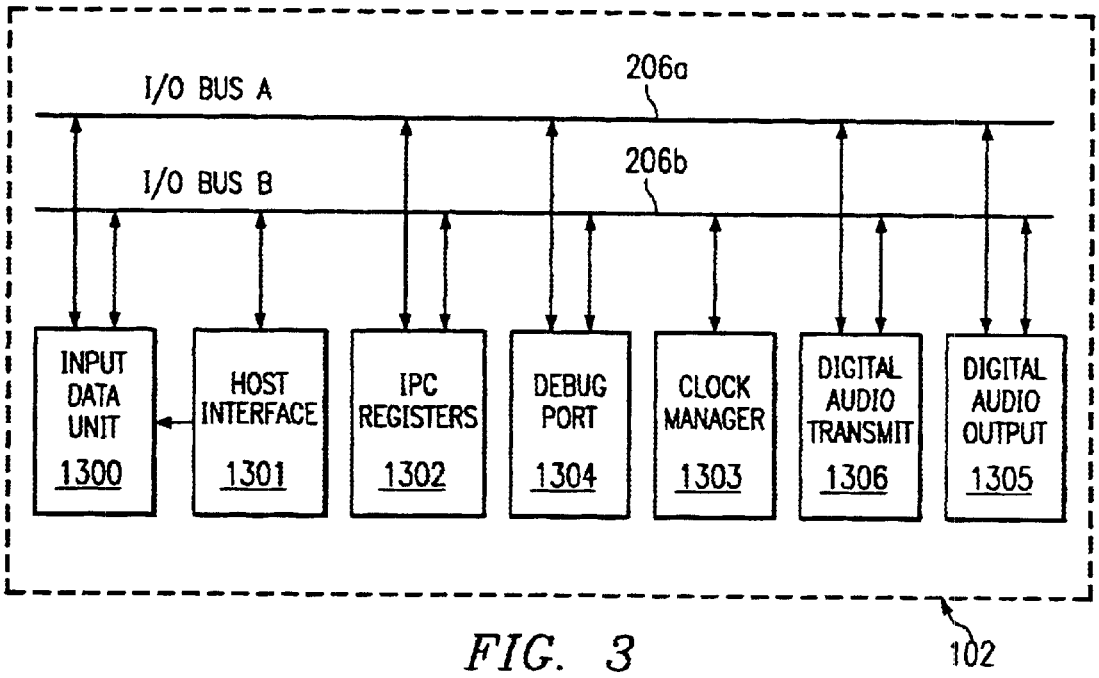
FIG. 3 is a diagram of the primary functional subblock of the I/O block of FIG. 1C.

DSP cores 200*a* and 200*b* are each based upon a time-multiplexed dual-bus architecture as depicted in further detail in FIG. 3. As shown in both FIG. 2 and FIG. 3, DSPs 200*a* and 200*b* are each associated with program and data RAM blocks 202 and 203. Data Memory 203 typically contains buffered audio data and intermediate processing results. Program Memory 201/202 (referring to Program RAM 201 and Program ROM 202 collectively) contains the program running at a particular time. Program Memory 201/202 is also typically used to store filter coefficients, as required by the respective DSP 200*a* and 200*b* during processing.

DSP cores 200*a* and 200*b* also respectively include a Data Address unit 301 for generating addresses to data memory 203, Program Address unit 301 for generating addresses to Program Memory 201/202, Execution Unit 303 which includes the circuitry required to perform arithmetic and logic operations on data received from either data memory or program memory, and buses 305 and 306 for carrying instructions to data to support DSP operations.

FIG. 3 is a detailed functional block diagram of I/O block 102. Generally, I/O block 102 contains peripherals for data input, data output, communications, and control. Input Data Unit 1200 accepts either compressed analog data or digital audio in any one of several input formats (from either the CDI or DAI ports). Serial/parallel host interface 1301 allows an external controller to communicate with decoder 100 through the HOST port. Data received at the host interface port 1301 can also be routed to input data unit 1300.

IPC (Inter-processor Communication) registers 1302 support a control-messaging protocol for communication between processing cores 200 over a relatively low-bandwidth communication channel. High-bandwidth data can be passed between cores 200 via shared memory 204 in processor block 101.

Clock manager 1303 is a programmable PLL/clock synthesizer that generates common audio clock rates from any selected one of a number of common input clock rates through the CLKIN port. Clock manager 1303 includes an STC counter which generates time stamp information used by processor block 101 for managing playback and synchronization tasks. Clock manager 1303 also includes a programmable timer to generate periodic interrupts to processor block 101.

Debug circuitry 1304 is provided to assist in applications development and system debug using an external DEBUGGER and the DEBUG port, as well as providing a mechanism to monitor system functions during device operation.

A Digital Audio Output port 1305 provides multichannel digital audio output in selected standard digital audio formats. A Digital Audio Transmitter 1306 provides digital audio output in formats compatible with S/PDIF or AES/EBU.

In general, I/O registers are visible on both I/O buses, allowing access by either DSPA (200*a*) or DSPB (200*b*). Any read or write conflicts are resolved by treating DSPB as the master and ignoring DSPA.

The principles of the present invention further allow for methods of decoding compressed audio data, as well as for methods and software for operating decoder 100. These principles will be discussed in further detail below. Initially, a brief discussion of the theory of operation of decoder 100 will be undertaken.

The Host can choose between serial and parallel boot modes during the reset sequence. The Host interface mode and autobit mode status bits, available to DSPB 200*b* in the HOSTCTL register MODE field, control the boot mode selection. Since the host or an external host ROM always communicates through DSPB. DSPA 200*a* and 200*b* receives code from DSPB 200*b* in the same fashion, regardless of the host mode selected.

In a dual-processor environment like decoder 100, it is important to partition the software application optimally between the two processors 200*a*, 200*b* to maximize processor usage and minimize inter-processor communication. For this the dependencies and scheduling of the tasks of each processor must be analyzed. The algorithm must be partitioned such that one processor does not unduly wait for the other and later be forced to catch up with pending tasks. For example, in most audio decompression tasks including Dolby AC-3, the algorithm being executed consists of 2 major stages: 1) parsing the input bitstream with specified/computed bit allocation and generating frequency-domain transform coefficients for each channel; and 2) performing the inverse transform to generate time-domain PCM samples for each channel. Based on this and the hardware resources available in each processor, and accounting for other housekeeping tasks the algorithm can be suitably partitioned.

Usually, the software application will explicitly specify the desired output precision, dynamic range and distortion requirements. Apart from the intrinsic limitation of the compression algorithm itself, in an audio decompression task the inverse transform (reconstruction filter bank) is the stage which determines the precision of the output. Due to the finite-length of the registers in the DSP, each stage of processing (multiply+accumulate) will introduce noise due to elimination of the lesser significant bits. Adding features such as rounding and wider intermediate storage registers can alleviate the situation.

For example, Dolby AC-3 requires 20-bit resolution PCM output which corresponds to 120 dB of dynamic range. The decoder uses a 24-bit DSP which incorporates rounding, saturation and 48-bit accumulators in order to achieve the desired 20-bit precision. In addition, analog performance should at least preserve 95 dB S/N and have a frequency response of +/−0.5 dB from 3 Hz to 20 kHz.

Based on application and design requirements, a complex real-time system, such as audio decoder 100, is usually partitioned into hardware, firmware and software. The hardware functionality described above is implemented such that it can be programmed by software to implement different applications. The firmware is the fixed portion of software portion including the boot loader, other fixed function code and ROM tables. Since such a system can be programmed, it is advantageously flexible and has less hardware risk due to simpler hardware demands.

There are several benefits to the dual core (DSP) approach according to the principles of the present invention. DSP cores 200A and 200B can work in parallel, executing different portions of an algorithm and increasing the available processing bandwidth by almost 100%. Efficiency improvement depends on the application itself. The important thing in the software management is correct scheduling, so that the DSP engines 200A and 200B are not waiting for each other. The best utilization of all system resources can be achieved if the application is of such a nature that can be distributed to execute in parallel on two engines. Fortunately, most of the audio compression algorithms fall into this category, since they involve a transform coding followed by fairly complex bit allocation routine at the encoder. On the decoder side the inverse is done. Firstly, the bit allocation is recovered and the inverse transform is performed. This naturally leads into a very nice split of the decompression algorithm. The first DSP core (DSPA) works on parsing the input bitstream, recovering all data fields, computing bit allocation and passing the frequency domain transform coefficients to the second DSP (DSPB), which completes the task by performing the inverse transform (IFFT or IDCT depending on the algorithm). While the second DSP is finishing the transform for a channel n, the first DSP is working on the channel n+1, making the processing parallel and pipelined. The tasks are overlapping in time and as long as tasks are of the same complexity, there will be no waiting on either DSP side.

Figure 4:
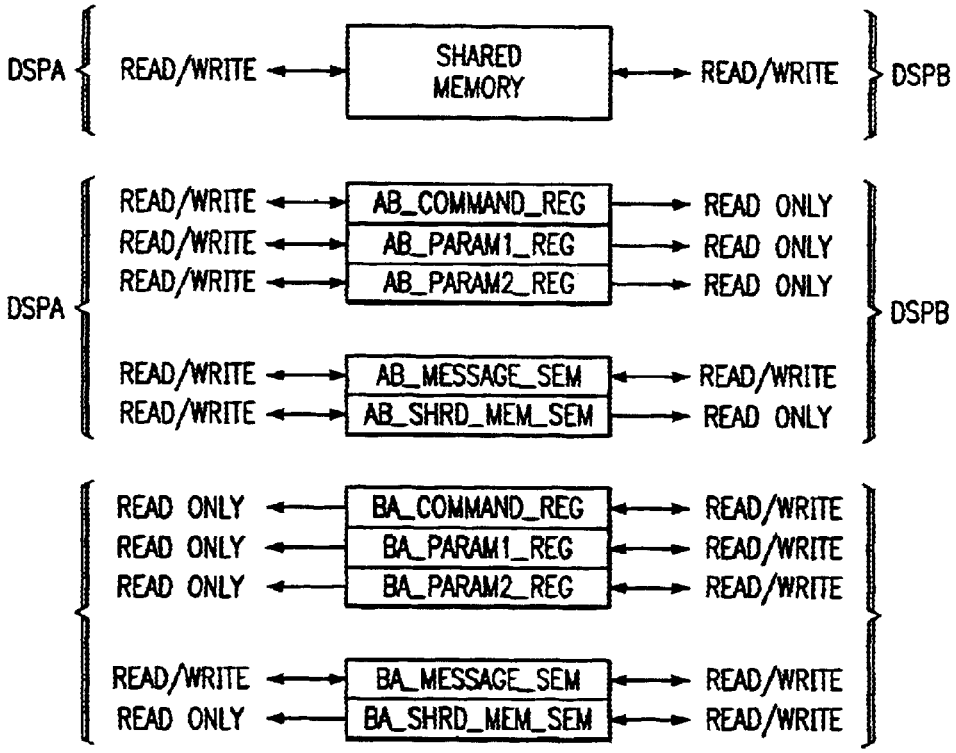
FIG. 4 is a diagram representing the shared memory space and IPC registers.

Decoder 100, as discussed above, includes shared memory of 544 words as well as communication "mailbox" (IPC block 1302) consisting of 10 I/O registers (5 for each direction of communication). FIG. 4 is a diagram representing the shared memory space and IPC registers (1302).

One set of communication registers looks like this (a) AB_command_register (DSPA write/read, DSPB read only)

(b) AB_parameter1_register (DSPA write/read, DSPB read only)

(c) AB_parameter2_register (DSPA write/read, DSPB read only)

(d) AB_message_semaphores (DSPA write/read, DSPB write/read as well)

(e) AB_shared_memory_semaphores (DSPA write/read, DSP B read only) where AB denotes the registers for communication from DSPA to DSPB. Similarly, the BA set of registers are used in the same manner, with simply DSPB being primarily the controlling processor.

Shared memory 204 is used as a high throughput channel, while communication registers serve as low bandwidth channel, as well as semaphore variables for protecting the shared resources.

Both DSPA and DSPA 200*a*, 200*b* can write to or read from shared memory 204. However, software management provides that the two DSPs never write to or read from shared memory in the same clock cycle. It is possible, however, that one DSP writes and the other reads from shared memory at the same time, given a two-phase clock in the DSP core. This way several virtual channels of communications could be created through shared memory. For example, one virtual channel is transfer of frequency domain coefficients of AC-3 stream and another virtual channel is transfer of PCM data independently of AC-3. While DSPA is putting the PCM data into shared memory, DSPB might be reading the AC-3 data at the same time. In this case both virtual channels have their own semaphore variables which reside in the AB_shared_memory_semaphores registers and also different physical portions of shared memory are dedicated to the two data channels. AB_command_register is connected to the interrupt logic so that any write access to that register by DSPA results in an interrupt being generated on the DSP B, if enabled. In general, I/O registers are designed to be written by one DSP and read by another. The only exception is AB message sempahore register which can be written by both DSPs. Full symmetry in communication is provided even though for most applications the data flow is from DSPA to DSP B. However, messages usually flow in either direction, another set of 5 registers are provided as shown in FIG. 4 with BA prefix, for communication from DSPB to DSPA.

The AB_message_sempahore register is very important since it synchronizes the message communication. For example, if DSPA wants to send the message to DSPB, first it must check that the mailbox is empty, meaning that the previous message was taken, by reading a bit from this register which controls the access to the mailbox. If the bit is cleared, DSPA can proceed with writing the message and setting this bit to 1, indicating a new state, transmit mailbox full. The DSPB may either poll this bit or receive an interrupt (if enabled on the DSPB side), to find out that new message has arrived. Once it processes the new message, it clears the flag in the register, indicating to DSPA that its transmit mailbox has been emptied. If DSPA had another message to send before the mailbox was cleared it would have put in the transmit queue, whose depth depends on how much message traffic exists in the system. During this time DSPA would be reading the mailbox full flag. After DSPB has cleared the flag (set it to zero), DSPA can proceed with the next message, and after putting the message in the mailbox it will set the flag to I. Obviously, in this case both DSPs have to have both write and read access to the same physical register. However, they will never write at the same time, since DSPA is reading flag until it is zero and setting it to 1, while DSPB is reading the flag (if in polling mode) until it is 1 and writing a zero into it. These two processes a staggered in time through software discipline and management.

When it comes to shared memory a similar concept is adopted. Here the AB_shared_memory_semaphore register is used. Once DSPA computes the transform coefficients but before it puts them into shared memory, it must check that the previous set of coefficients, for the previous channel has been taken by the DSPB. While DSPA is polling the semaphore bit which is in AB_shared_memory_semaphore register it may receive a message from DSPB, via interrupt, that the coefficients are taken. In this case DSPA resets the semaphore bit in the register in its interrupt handler. This way DSPA has an exclusive write access to the AB_shared_memory_semaphore register, while DSPB can only read from it. In case of AC-3, DSPB is polling for the availability of data in shared memory in its main loop, because the dynamics of the decode process is data driven. In other words there is no need to interrupt DSPB with the message that the data is ready, since at that point DSPB may not be able to take it anyway, since it is busy finishing the previous channel. Once DSPB is ready to take the next channel it will ask for it. Basically, data cannot be pushed to DSPB, it must be pulled from the shared memory by DSPB.

The exclusive write access to the AB_shared_memory_semaphore register by DSPA is all that more important if there is another virtual channel (PCM data) implemented. In this case, DSPA might be putting the PCM data into shared memory while DSPB is taking AC-3 data from it. So, if DSPB was to set the flag to zero, for the AC-3 channel, and DSPA was to set PCM flag to 1 there would be an access collision and system failure will result. For this reason, DSPB is simply sending message that it took the data from shared memory and DSPA is setting shared memory flags to zero in its interrupt handler. This way full synchronization is achieved and no access violations performed.

When designing a real time embedded system both hardware and software designers are faced with several important trade-off decisions. For a given application a careful balance must be obtained between memory utilization and the usage of available processing bandwidth. For most applications there exist a very strong relationship between the two: memory can be saved by using more MIPS or MIPS could be saved by using more memory. Obviously, the trade-off exists within certain boundaries, where a minimum amount of memory is mandatory and a minimum amount of processing bandwidth is mandatory.

The proper input FIFO is important not only for the correct operation of the DSP chip itself, but it can simplify the overall system in which decoder 100 reside. For example, in a set-top box, where AC-3 audio is multiplexed in the MPEG2 transport stream, the minimum buffering requirement (per the MPEG spec) is 4 kbytes. Given the 8 kbyte input FIFO in decoder 100 (divisible arbitrarily in two, with minimum resolution of 512 bytes), any audio bursts from the correctly multiplexed MPEG2 transport stream can be accepted, meaning that no extra buffering is required upstream in the associated demux chip. In other words, demux will simply pass any audio data directly to the codec 100, regardless of the transport bit rate, thereby reducing overall system cost.

Also, a significant amount of MIPS can be saved in the output FIFOs, which act as a DMA engine, feeding data to the external DACs. In case there are no output FIFOs the DSP has to be interrupted at the Fs rate (sampling frequency rate). Every interrupt has some amount of overhead associated with switching the context, setting up the pointers, etc. In the case of the codec 100, a 32 sample output is provided FIFO with half-empty interrupt signal to the DSP, meaning that the DSP is now interrupted at Fs/16 rate. Subsequently, any interrupt overhead is reduced by a factor of 16 as well, which can result in 2–3 MIPS of savings.

In the dual DSP architecture of decoder 100 the amount of shared memory is critical. Since this memory is essentially dual ported resulting in much larger memory cells and occupying much more die area, it is very critical to size it properly. Since decoder 100 has two input data ports, and the input FIFO is divisible to receive data simultaneously from the two ports, the shared memory was also designed to handle two data channels. Since the size of one channel of one block of AC-3 data is 256 transform coefficients a 256 element array has been allocated. That is, 256 PCM samples can be transferred at the same time while transferring AC-3 transform coefficients. However, to keep two DSP cores 200*a* and 200*b* in sync and in the same context, an additional 32 memory locations are provided to send a context descriptor with each channel from DSPA to DSPB. This results in the total shared memory size of 544 elements, which is sufficient not only for AC-3 decompression implementation but also for MPEG 5.1 channel decompression as well as DTS audio decompression.

The dual DSP architecture of decoder 100 can also advantageously support pulse-code modulated (PCM) applications. Here, the input comprises one or more channels of sampled digital audio and DSPs 200 perform selected filtering, mixing and other digital signal processing functions to create one or more audio channels. Examples of such applications include matrix surround decoding (e.g. ProLogic, Circle Surround, Logic7), 3-D virtualization (e.g. Dolby Virtual, QSound), noise reduction, parametric and graphic equalization, dynamic range compression and expansion, and sound reverberation effects.

During typical surround effects processing, DSPs 200 accept a standard stereo audio input and synthesize cues to simulate a different listening environment, such as a larger room and/or different acoustics. To do so, the processing must embody an understanding of the physics of room acoustics.

In a concert hall, the tones made by an instrument or voice on stage reach the members of the audience via multiple paths. For example, a given tone may travel directly to the listener, reflect off a single surface of the hall, such as the walls or ceiling, before reaching the listener, or take a path including multiple reflections off multiple surfaces. Each path causes a corresponding attenuation in amplitude and introduces a given amount of time delay between the instrument and the listener. For example, the most direct path to the user will result in less attenuation and time delay than a path which includes multiple reflections off the hall surfaces. Thus, instead of hearing a single well defined tone, the listener instead hears a continuum of the tone which decreases in amplitude with time. This "reverberation" adds tone depth and texture, and along with the fact that the tones are reaching the listener from various reflections (echoes) around the room, gives the effect that the listener is being surrounded by sound.

In contrast, studio recordings are typically made in an anechoic environment. Without more, the tones from a studio recording will sound sharp and unidirectional. Therefore, reverberation or "surround sound" processing is often done during playback to help simulate the concert hall environment. In this type of processing, a model is taken of an actual concert hall by producing an impulse signal or "click" and then observing the amplitudes and time delays of the echoes reaching a measurement point in the hall. The response to a typical test is shown in FIG. 5.

As shown in the figure, the response to the click is a series of echoes of varying amplitudes and spacings. These echoes can be categorized as the early echoes and the late echoes or tail. The early echoes are generally well behaved in amplitude and spacing. In the tail however, the echo density increases substantially and the amplitudes generally fall-off rapidly. From this model, delays and amplitude shaping can be applied to a studio recording during playback processing to create the surround sound effect. While there are many possible models, the principles of the present invention are described herein with reference to that model described in Moorer, J. *This Reverberation Business*, Computer Music Journal, 1980.

Figure 6:
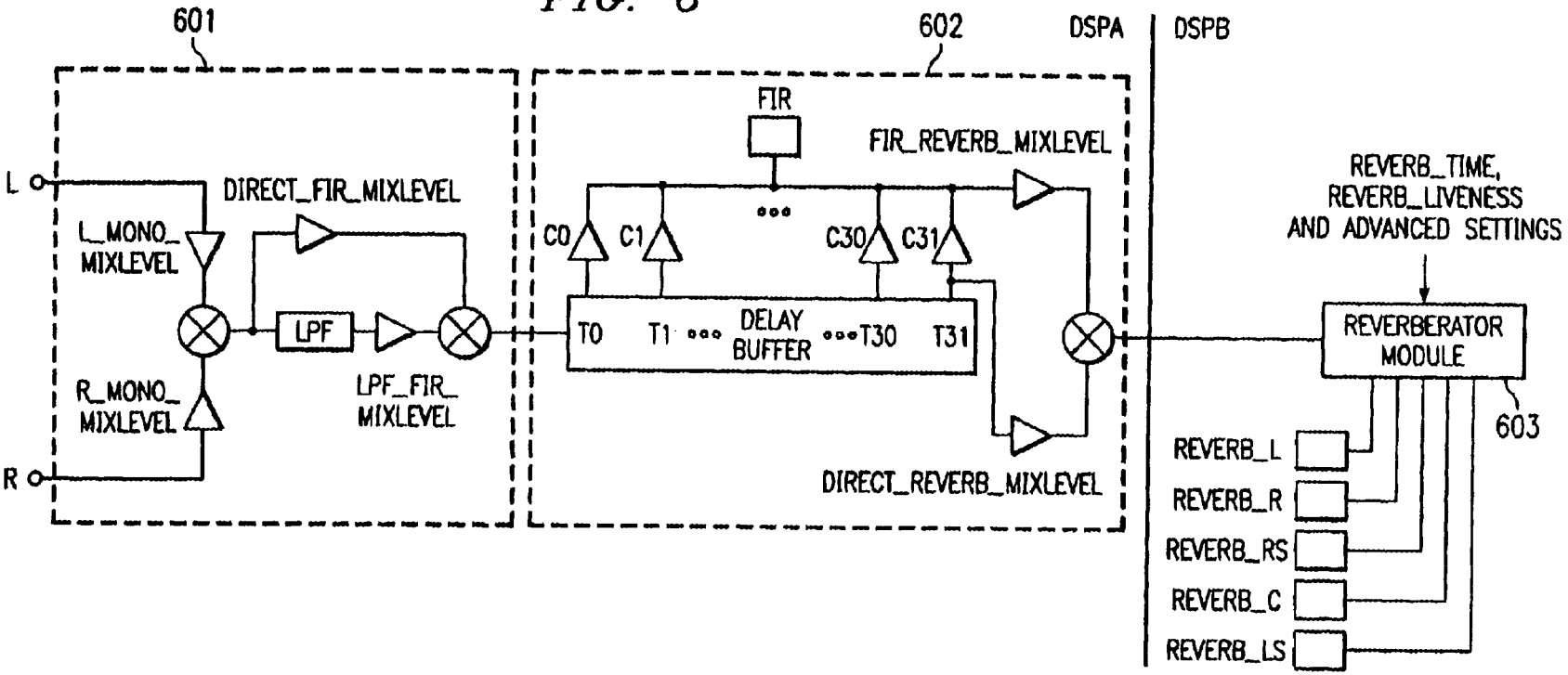
FIG. 6 is a diagram describing the top level functioning of a reverberation/surround sound process embodied in software and executed on DSPA and DSPA according to the depicted partitioning.

FIG. 6 is a diagram describing the top level functioning of a reverberation/surround sound process 600 embodied in software and executed on DSPA and DSPA according to the depicted partitioning. In the present discussion, while the structures shown in FIG. 6 are discussed and numbered as discrete devices, it should be recognized that they are preferably software constructions and are not necessarily as clearly partitioned in actual applications. Notwithstanding, the present inventive principles can be implemented in whole or in part by hardware. The partitioning can also vary from application to application depending on the available resources.

At the front end 601, left and right digital audio data is received, adjusted in gain to set the respective mix levels, and then mixed to produce a mono signal. The mono signal is passed through a low pass filter (LPF), its mixed level is adjusted, and then mixed with its mix level adjusted unfiltered (direct) version. The LPF is for example a first order filter with a corner frequency of Fs/6. The variable mix levels of the direct and filtered paths are used to control surround effect "brightness" by allowing the user to control the amount of high frequency components allowed in the mix.

The output of front end 601 is passed to the input of a finite impulse response (FIR) filter 602. FIR filter 602 is preferably based upon a 5616-sample delay buffer which provides up to 117 msec of delay at Fs=48 KHz or 127.35 msec at Fs=44 KHz. In the illustrated embodiment 32 taps (T0–T31) are used as arbitrarily programmed by the end user. The FIR filter coefficients C0–C31 correspond to the delay buffer taps T0–T31. Since the FIR filter can be used to model the early echoes discussed above, the output FIR is sent on to the output channel mixer shown in FIG. 7. The output to the reverberator module is generated by taking the output of the FIR filter, adjusting the mix levels, and mixing it with the output of Tap 31 of the delay buffer. Tap 31 either defaults to 0 or is set to delay the impulse response of the following reverberator module to align with the end of the early reflections produced by FIR filter 602.

In the illustrated embodiment, the front end and FIR filter functions are performed by DSPA. The mono reverberation output from filter block 602 is then passed to DSPB through a channel in shared memory using the IPC protocol discussed above. Similarly, the scaled LR input is also passed to DSPB using other channels in shared memory. DSPB takes the mono reverberation data and implements reverberator module 603, the details of which are described further in conjunction with FIGS. 8A–8C.

Figure 8A:
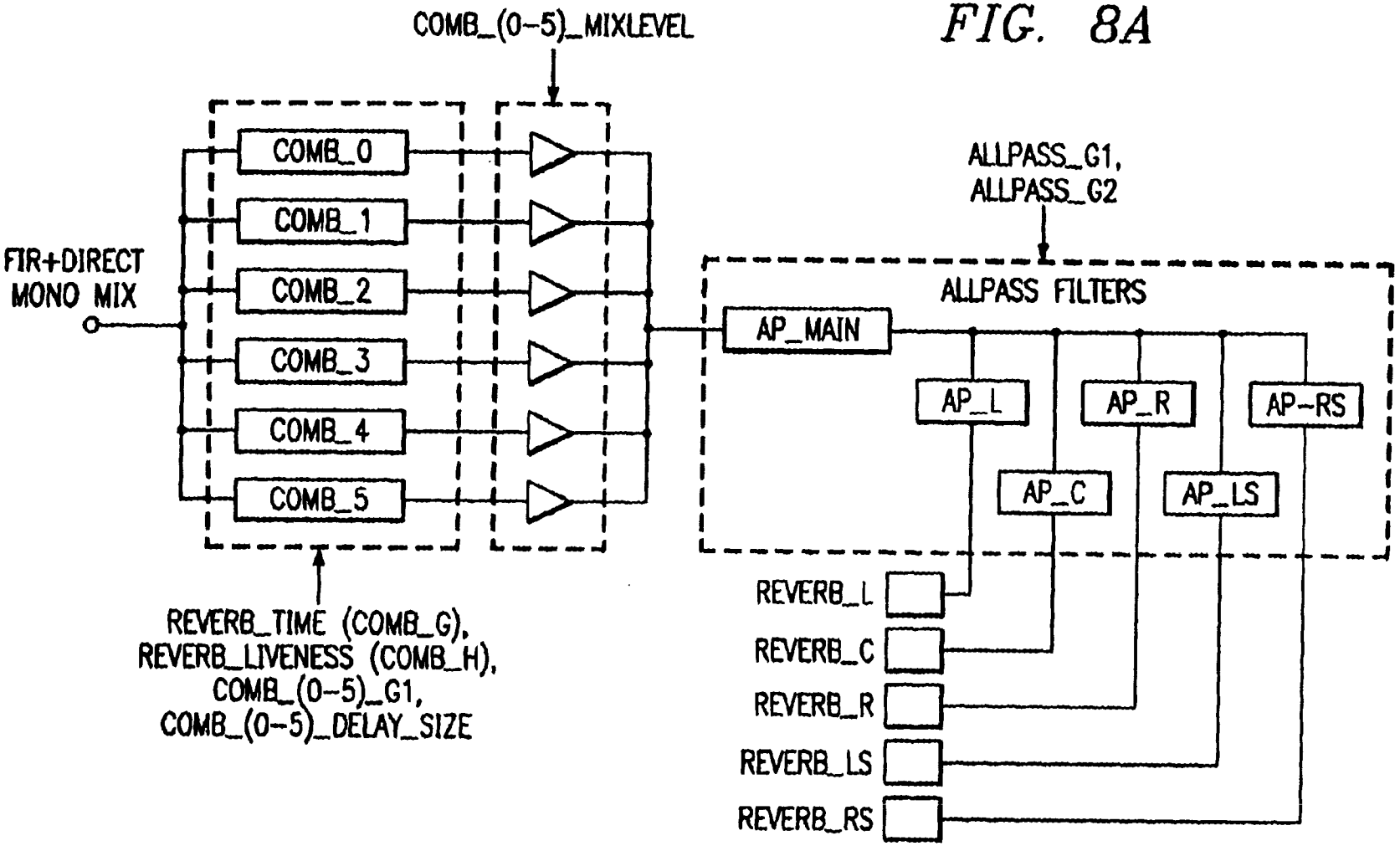
FIG. 8A is a diagram illustrating reverberation effects created by taking the single channel (mono) data from FIR filter 602 and producing six channels replicating dense after-reflections caused by the hall surfaces and their transitions using a bank of comb filters 801.

As shown in FIG. 8A, reverberation effects are created by taking the single channel (mono) data from FIR filter 602 and producing six channels replicating dense after-reflections caused by the hall surfaces and their transitions using a bank of comb filters 801. These six channels are then passed through a set of independent all-pass filters 802 which further simulate after-reflections and decorrelate the six channels.

Figure 8B:
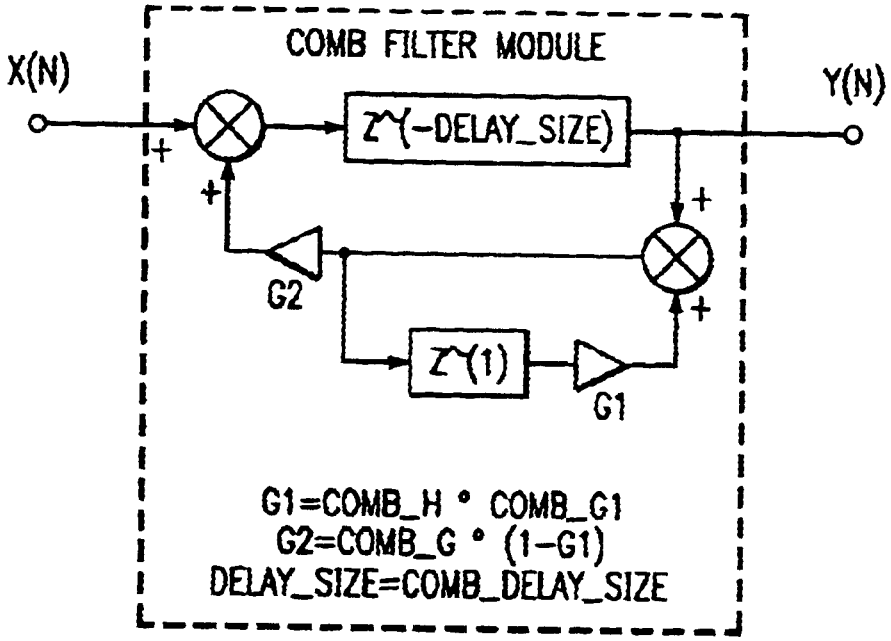
FIG. 8B is a diagram illustrating the preferred form of the comb filters.

The comb filters preferably take the form shown in FIG. 8B. Each comb filter reproduces the input with a periodic delay and decaying amplitude. A low pass filter in the feedback loop simulates the absorption of high frequencies by air, which makes the sound reaching the listener less "tinny."

As already indicated, the six comb filters are used in parallel to produce dense after-reflections. The delay sizes of the combs preferrably are chosen to be mutually prime to avoid echos coinciding from different combs. Preferably, the delays of each comb is roughly 10% more than that of the previous one. The coefficients G1 and G2 for a given comb filter should satisfy G1+G2<1 for stability. G1 and G2 are derived for each comb automatically as shown in FIG. 8B using the parameters Comb_g, Comb_h, and Comb_0–5_g1. This scheme generally works as follows:

Increasing (or decreasing) Reverb_Time (Comb_g) parameter increases (or decreases) the length of the after-reflection tail since it scales up (or down) the feedback in the comb.

Increasing (or decreasing) the Reverb_Liveness (Comb_h) parameter increases (or decreases) the amount of LPF action in the feedback, thus making the sound more (or less) dampened. This is particularly important to reduce the clicking effect when reverberating short impulsive sounds It may be found that the reverberation caused by a given comb filter (among the six) is audibly predominant and produces a buzzing sound. To overcome this, the corresponding mixlevel for that filter can be reduced to equalize its audible effect with respect to the others. These can also be used to overcome overflow issues that may happen with different choices of g1, g2, and h.

Figure 8C:
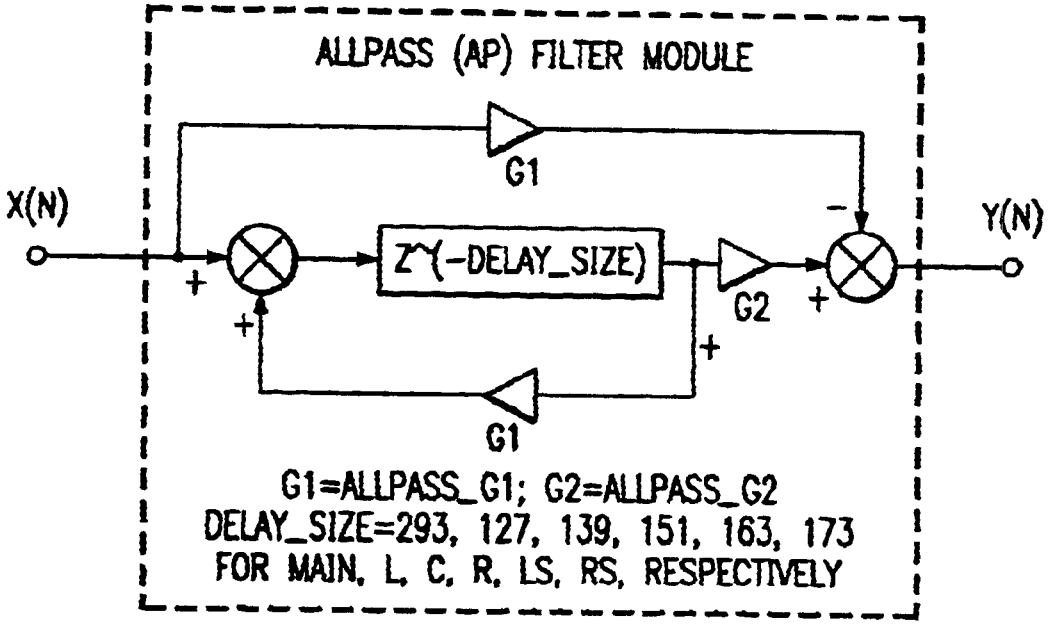
FIG. 8C is a diagram illustrating the all-pass filters providing another means of simulating after-reflections.

The all-pass filters (FIG. 8C) provide an additional means of simulating after-reflections. In addition, they are used here to decorrelate the different channel outputs from each other. The delay sizes are fixed (as shown in FIG. 8C) and every all-pass filter shares the same values of coefficients G1 and G2. However, these can be set by the host via messaging. For stability, G2<=1−G1^2 should be guaranteed by the host. Increasing (or decreasing) the G2 parameter increases (or decreases) the reverberation time (i.e. the length of the after-reflection tail) by scaling up (or down) the reverberated contribution to the output.

FIG. 7 is a diagram of the 6-channel effects output mixer, which mixes together the left and right stereo input data, the FIR filter output and the corresponding output of reverberator module 603, at selected mix levels (in FIG. 7, "Mlv" stands for mixlevel). The resulting signals are Left (L), Right (R), Right Surround (RS), Center (C), Left surround (LS), and low frequency (LFE). These outputs drive the system backend digital to analog converters in the audio receiver, after any other processing required by the system.

As discussed above, the present inventive principles can be advantageously embodied in a single chip audio decoder based on a dual-DSP architecture. In order to minimize chip area in the single-chip embodiment, the size of the memory must be minimized and its usage correspondingly optimized. In the illustrated embodiment, DSPA is supported by a 3 k by 24 data RAM and a 4 k by 24 program RAM. DSPB is supported by an 8 k by 24 data RAM and a 4 k by 24 program RAM. In each case, areas data RAM and program RAM can be used as required by the corresponding processor. One processor can also access the memory of the other, if the shared memory IPC protocol set out above is utilized, albeit at some cost of MIPs and latency.

To give the broadest range available for setting the taps in FIR filter 602, the length of the delay buffer must be maximized with respect to the available resources. For DSPA, which implements the delay buffer, approximately 1 k of the locations in program memory are already required for program code and ½ k of data memory is required for storing data variables and coefficients. This leaves approximately 2.5 k of data memory and 3 k of program memory available to support the delay buffer, without resort to any of the DSPB program or data memory.

A single logical or virtual delay buffer can be implemented, even though the available physical memory is split across the DSPA program and data memories. An example of such a split is illustrated in FIG. 9A. For illustrative purposes, it will be assumed that the addressing is linear, although this is not a requirement. The DSPA data memory (DMEM) has an available capacity of 2560 samples associated with physical addresses D0–D2559 or virtual addresses 0–2559. The DSPA program memory has an available capacity of 3072 samples associated with virtual addresses 2560–5631 or physical addresses P0–P3071.

The virtual addresses occupy the complete available memory size of 0–5631 and simplify the task of implementing a pointer structure for the delay buffer. In this respect, a virtual pointer is implemented exactly as a physical pointer in a single large data or program memory buffer of size 5632. However, every access to memory to or from this virtual pointer requires mapping the virtual address to the corresponding physical address and then accessing that physical address location. For example, a virtual address of 31 would corresponding to a physical address of D(31−0)= D31 in data memory. Similarly, a virtual address of 3129 would correspond to a physical address of D(3129−2560)= P569 in program memory.

Figure 9B:
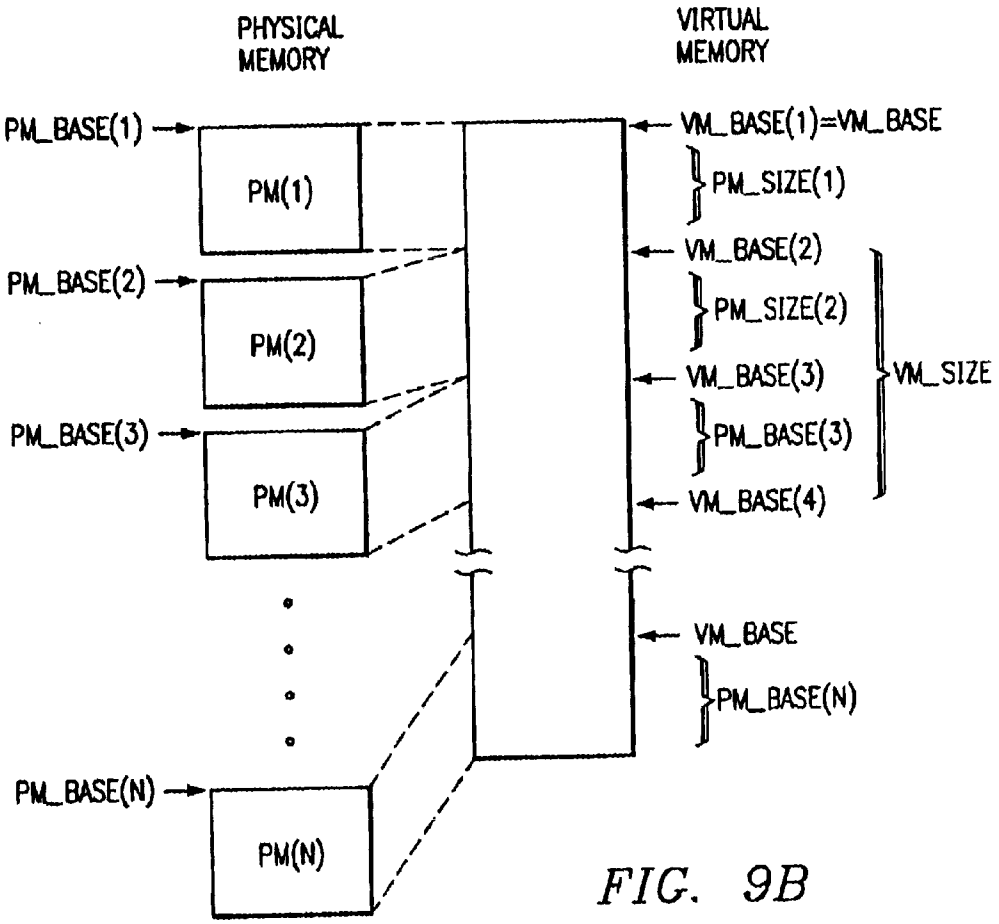
FIG. 9B is a diagram of an exemplary mapping of virtual memory addresses to physical memory addresses.
Figure 9A:
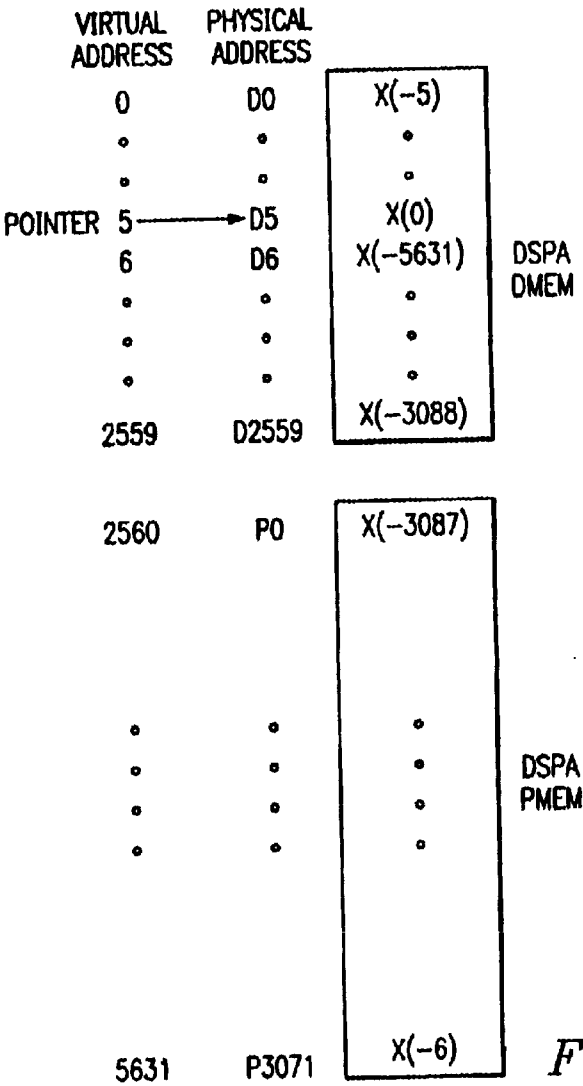
FIG. 9A is a diagram of an example of a buffer split across the DSPA program and data memory spaces.

FIG. 9B is a more detailed diagram of one possible mapping between virtual memory and physical memory. In this case, the virtual memory is comprised of VM_SIZE number of virtual locations, each associated with a virtual address starting virtual base address VM_BASE. While the locations in virtual memory are contiguous, for reference they are partitioned into i number of blocks of PM_SIZE(i) number of locations each starting at virtual address VM_BASE (i), where i=0, . . . , n and PM_SIZE (i) represents the size of the block in physical memory to which the block in virtual memory maps. Accordingly, there are i number of corresponding blocks of physical memory PM(i). Thus, for example the block of virtual locations corresponding to addresses VM_BASE(1) to VM_BASE(2)−1 are mapped to physical block PM(1), and so on.

In the following discussion, unless otherwise indicated, the term "address" will refer to the virtual address which is mapped to physical addresses as described above in actual implementation.

The virtual pointer points to the location where the current sample to the delay buffer is to be written, in this case the location at Address 5 was arbitrarily chosen as an example and the data being written to the delay buffer indexed X(0). As each new word is received the pointer increments by one address. Thus, in the present example where the current sample X(0) is at Address 5, the previous sample input is sample X(−1) at Address 4. The samples thereafter continue with decreasing address until Address 0, which stores sample X(−5), and then wrap around. In this example, sample X(−6) wraps around to address 5631 (i.e. physical address P3071) in PMEM.

As the addresses decrease from Address 5631, the currency of the data also decreases such that sample X(−5631) at Address 6 is the least current (oldest) sample in the buffer. With the next sample, the pointer moves to Address 6 and the new sample replaces the least current sample. The sample at Address 6 is now the most current sample X(0), Address 5 stores sample X(−1), and so on until Address 7 holds the oldest sample X(−5631). In other words, the indices of the samples remap incrementally as each new sample is written-in.

In this fashion, a sufficiently long delay buffer can be created using multiple segments of the available memory in both DMEM and PMEM of DSPA. If the time penalty through the IPC system is tolerable, the buffer length can be further extended by mapping-in available program and/or data memory space in the DSPB program and data memory.

Although the invention has been described with reference to a specific embodiments, these descriptions are not meant to be construed in a limiting sense. various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

What is claimed:

1. A method of producing reverberation effects comprising the steps of:

partitioning processing tasks between a plurality of processors;

implementing a filter for modeling early acoustic reflections in response to an input signal, the filter including a delay buffer of a selected length and having a selected number of taps for tapping samples of corresponding amounts of delay and a summer for summing the tapped samples to generate a filter output signal, the delay buffer set-up in virtual memory using areas of program and data memories associated with the first processor; and implementing a reverberator for modeling late acoustic reflections, the reverberator receiving the fitter output and generating a plurality of output signals.

2. the method of claim 1 wherein said step of implementing a reverberator comprises the step of:

passing the filter output through a plurality of parallel comb filters to generate a plurality of signals; and passing each of said plurality of signals through an all-pass filter to generate said plurality of output signals.

3. The method of claim 1 and further comprising the step of generating the input signal to the filter using the first processor comprising the steps of:

summing together left and right stereo audio data to generate an unfiltered mono audio signal;

filtering the unfiltered mono audio signal to generate a filtered mono audio signal; and summing at selected mix levels the filtered and unfiltered mono audio signals to generate the input signal to the finite impulse response filter.

4. The method of claim 1 wherein step of implementing a filter comprises the step of implementing a filter using a first one of the processors and the step of implementing a reverberator comprises the step of implementing a reverberator using a second one of the processors.

5. The method of claim 1 wherein implementing the delay buffer comprises the step of setting up a wrap-around buffer wherein a current datum is stored at a location pointed to by a virtual pointer, the last datum entered is stored at a location having the address of the pointer minus one and the least current data is stored in a location having the address of the pointer plus one.

6. the method of claim 1 and further comprising the step of selectively mixing the plurality of output signals with left and right stereo data.

7. A method of operating a single-chip dual-processor audio device comprising the steps of:

with a first processor, performing the steps of:

selectively combining digital stereo audio input signals to generate a single mono data signal; and filtering a first single mono data signal with a finite impulse response filter; and with the second processor, performing the steps of:

filtering an output of the finite impulse response filter to obtain a plurality of filtered signals each having a selected delay and a decaying amplitude; and selectively mixing each of the plurality of filtered signals with the output of the finite impulse response filter and the input audio signals to produce a plurality of audio output signals with a reverberation component.

8. The method of claim 7 wherein said step of filtering the mono data signal with a finite impulse response filter comprises the substep of selectively tapping a delay buffer to simulate early acoustic reflections of a room of a corresponding size.

9. The method of claim 7 wherein said step of filtering the output of the finite impulse response filter comprises the substep of passing the output of the finite impulse response filter through a plurality of parallel comb filters to produce a plurality of signals simulating dense after-reflections.

10. The method of claim 5 wherein said step of filtering the output of the finite impulse response filter further comprises the substep of passing the plurality of signals output from the comb filters through a corresponding plurality of all-pass filters for decorrelation.

11. The method of claim 7 wherein the first and second processors comprises digital signal processors.

12. The method of claim 8 and further comprising the step of implementing the delay buffer in memory according to the substeps of:

pointing to a current address in memory; and writing a current data sample at the current address such that data at the previous pointer address in the next most current and the data at the next pointer address is the least current.

13. The method of claim 10 wherein the first processor is associated with program and data memories and said step of implementing the delay buffer comprises the step of comprises the step of implementing a long delay buffer crossing boundaries of the program and data memories.

14. An audio data processing system comprising:

a source of digitized audio data;

a audio decoder system with surround sound support comprising:

a memory;

a first digital signal processor operable to simulate early acoustic reflections by filtering said digitized audio data using a delay buffer setup in said memory;

a second digital signal processor operable to receive a stream of data from the first processor and model late acoustic reflections and output a plurality of streams of surround sound audio data signals; and inter-processor communications circuitry for transferring the stream of data from the first processor to the second processor through shared memory; and circuitry for driving a plurality of speakers using the surround sound audio data to simulate a selected environment.

15. The audio data processing system of claim 14 wherein said first processor is operable to implement a finite impulse response filter in software using said delay buffer.

16. The audio data processing system of claim 14 wherein said memory comprises program and data memories associated with sold first processor and said delay buffer is setup in both said program and data memories associated with said first processor.

17. The audio data processing system of claim 14 wherein said second processor is operable to model said late acoustic reflections by implementing a plurality of comb filters in software.

18. The audio data processing system of claim 17 wherein said second processor is operable to further model said late acoustic reflections by implementing a plurality of all-pass filters in software.

19. The audio data processing system of claim 14 wherein selected said surround sound signals define left, right and center channels.

20. The audio data processing system of claim 14 wherein selected said surround sound signals define right surround sound and left surround sound channels.

21. The audio data processing system of claim 14 wherein a selected said surround sound signal defines a low frequency channel.

* * * * *